United States Patent [19]

Zhukov et al.

[11] 4,170,944

[45] Oct. 16, 1979

[54] ARRANGEMENT FOR TRANSPORTATION OF CARGOES IN CONTAINERS

[76] Inventors: Evgeny I. Zhukov, Simferopolsky bulvar, 14, kv. 69; Viktor A. Kichulkin, Nagornaya ulitsa, 45, korpus 23, kv. 11; Vladimir Y. Tsernes, Kirovogradskaya ulitsa, 24, korpus 3, kv. 204; Alexandr B. Shekhel, Snaiperskaya ulitsa, 5, kv. 161; Naum Y. Kershenbaum, ulitsa Medikov, 6, kv. 38; Evgeny N. Senderov, Matveevskaya ulitsa, 10, korpus 2, kv. 25; Oleg G. Ivoilov, ulitsa Perovskaya, 59, kv. 51, all of Moscow, U.S.S.R.

[21] Appl. No.: 807,634

[22] Filed: Jun. 17, 1977

[51] Int. Cl.[2] ..... B61B 13/10

[52] U.S. Cl. ..... 104/138 R; 104/155; 105/365; 188/2 R

[58] Field of Search ..... 104/23 FS, 134, 138 R, 104/155; 105/365; 243/38, 39, 3, 6; 188/2 R, 32

[56] References Cited

U.S. PATENT DOCUMENTS

| | | | |
|---|---|---|---|
| 2,761,633 | 9/1956 | Sindzinki | 243/38 |
| 3,724,690 | 4/1973 | Bates | 104/155 |
| 3,724,691 | 4/1973 | Carstens et al. | 104/155 |
| 3,797,405 | 3/1974 | Carstens et al. | 243/6 |
| 3,830,161 | 8/1974 | Bacon | 104/70 |

*Primary Examiner*—Albert J. Makay

*Assistant Examiner*—Ross Weaver

*Attorney, Agent, or Firm*—Fleit & Jacobson

[57] ABSTRACT

An arrangement for transportation of cargoes in containers along a closed loop track having at least two spaced handling stations each station having a zone of reception of containers and a zone of delivery of containers, each portion of the track connecting the zone of delivery of one handling station to the zone of reception of an adjacent handling station comprising a pipeline communicating, via air admission pipes, with a source of compressed air for moving the containers, and each container having at least one sealing member closing the cross-sectional area of the pipeline. The zone of reception of each handling station comprises a portion of the track permanently communicating with atmosphere and inclined in the direction of movement of containers, and the zone of delivery of each handling station comprising a portion of the track permanently communicating with atmosphere and an independent drive for moving the containers along this portion of the track. The air admission pipes connecting the pipelines to the source of compressed air are spaced from the entrance to each pipeline at a distance which is at least equal to the distance between the adjacent sealing members of the adjacent containers when they are in the closest position relative to each other. This construction of the arrangement lowers the manufacturing cost and improves the throughput capacity in operation.

6 Claims, 10 Drawing Figures

ARRANGEMENT FOR TRANSPORTATION OF CARGOES IN CONTAINERS

The invention relates to arrangements for transportation of cargoes in containers along closed loop tracks.

The arrangement for transportation of cargoes in containers according to the invention may be most advantageously used for transporting cargoes at relatively short distances.

Known in the art are arrangements for pneumatic transportation of cargo in containers along a closed loop pipeline. Such arrangements have compressed air sources—air blowing stations—communicating, via air admission pipes, with the pipeline for moving containers therealong. Each container has sealing members with the outside diameter which is substantially equal to the inside diameter of the pipeline. The sealing members close the cross-section of the pipeline.

Loading and unloading stations are arranged at the pipeline in a spaced relationship to each other. Each of the stations has the zone of reception of containers, a zone for loading/unloading of containers and a zone of delivery. The zone of reception of containers at each handling station comprises a portion of the pipeline having pipes which incorporate throttle valves and are arranged in series to connect this portion of the pipeline to atmosphere for air discharge. The zone of delivery of containers comprises a portion of the pipeline and a bypass duct connected thereto with its ends. The bypass duct communicates, via an air admission pipe, with a source of compressed air (air blowing station). A controlled valve is provided in the bypass duct intermediate of the point of connection of the air admission pipe thereto and the point of connection of the duct to the start (entrance) of the portion of the pipeline, the controlled valve directing the air flow to the pipeline.

In the above-described arrangements, relatively great numbers of air-distribution fittings (taps, valves, throttle valves) are installed in the zones of reception and delivery of each handling station thus making the handling stations sophisticated and costly, and consequently the entire arrangement as well. In addition, the use of compressed air for moving the containers in the zones of reception and delivery does not ensure their continuous movement without stoppages thus lowering the throughput capacity of the arrangement.

It is an object of the invention to simplify the construction of the zones of reception and delivery of the handling stations.

Another object of the invention is to lower the manufacturing cost of the handling stations.

Further object of the invention is to improve the throughput capacity of the arrangement.

Still another object of the invention is to prolong the service life of the arrangement for transportation of cargoes in containers.

With these and other objects in view, it is contemplated an arrangement for transportation of cargoes in containers along a closed loop track having at least two spaced handling stations, each station having a zone of reception of containers and a zone of delivery of containers, and each portion of the track which connects the zone of delivery of containers of one handling station to the zone of reception of the adjacent handling station comprising a pipeline communicating, via an air admission pipe, with a source of compressed air for moving the containers, and each container having at least one sealing member closing the cross-sectional area of the pipeline, wherein, according to the invention, the zone of reception of each handling station comprises a portion of the track permanently communicating with atmosphere and inclined in the direction of movement of the containers, the zone of delivery of each handling station comprising a portion of the track permanently communicating with atmosphere and an independent drive for moving the containers along this portion of the track, whereas the air admission pipes are spaced apart from the entrance to each pipeline at a distance equal to or greater than the distance between the adjacent sealing members of the adjacent container when the containers are in the closest position relative to each other and permanently communicate with the source of compressed air.

A portion of the track of the zone of reception of the handling station is preferably arcuated in the horizontal plane and has side rails, with a member made of friction material being secured to one rail having greater radius of curvature, the lateral side of each container also being provided with members of friction material secured thereto and adapted to engage the members of the side rails during the movement of the container along this portion of the pipeline.

This construction of the zone of reception of containers enables the braking to be effected by using centripetal forces and forces of friction which, in turn, provides for comparatively low and substantially equal speeds of containers at the end of the track within the zone of reception irrespective of the weight of containers and speed of their movement at the outlet of the pipeline.

It is expedient that the zone of reception of the handling station is provided with an independent drive for moving the containers along the portion of the track within this zone.

The provision of the independent drive in the zone of reception of containers ensures the formation of a continuous chain of closely arranged containers between the independent drive and the outlet of the pipeline so that the sealing member of the tail container closes the cross-sectional area of the pipeline at the outlet end thereof thus creating an air cushion between the tail container and the container moving along the pipeline adapted to brake it (a pneumatic buffer device).

It is advantageous that the independent drive comprises two vertically closed traction chains running in parallel with each other and interconnected by cross-pieces spaced equidistantly along the traction chains, the distance between the cross-pieces being equal to or less than the length of the container, and a roller interacting with the container is preferably mounted to each cross-piece substantially in the middle thereof in such a manner that its axle is in the same plane with pivots connecting links of the traction chain to the cross-piece and extends in parallel therewith.

Specific embodiments of the invention will now be described with reference to the accompanying drawings, in which.

Figure 6:
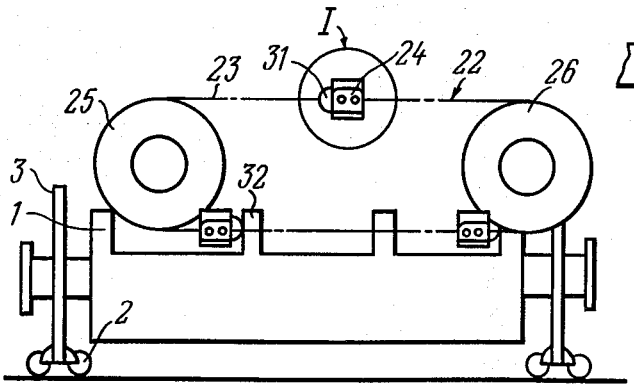
Figure 7:
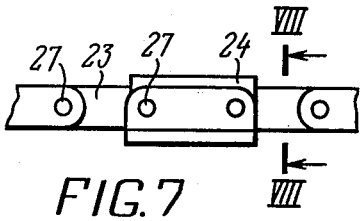
Figure 8:
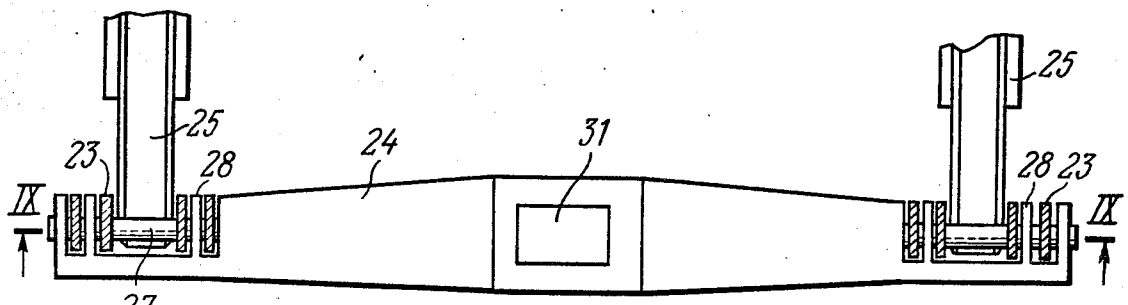
Figure 9:
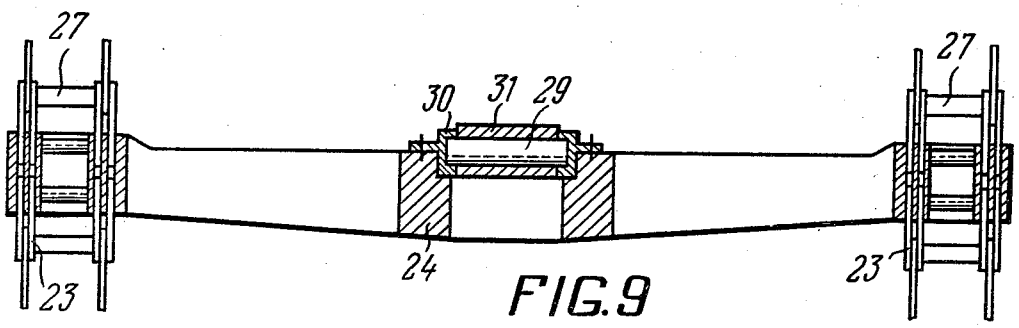

FIG. 6 diagrammatically shows the independent drive of a handling station;

FIG. 7 is an enlarged detail 1 in FIG. 6;

FIG. 8 is a sectional view taken along the line VIII—VIII in FIG. 7;

FIG. 9 is a sectional view taken along the line IX—IX in FIG. 8; and

Figure 10:
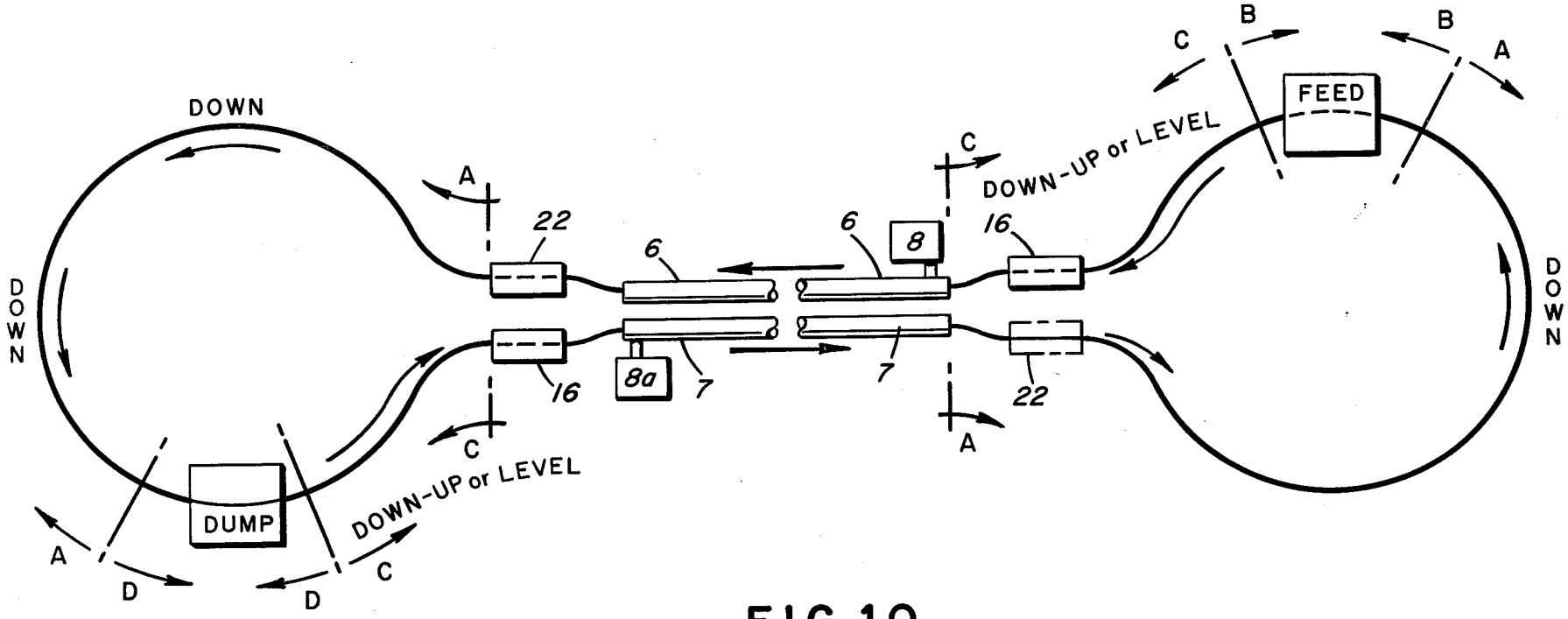

FIG. 10 is a schematic illustration of a typical layout of the arrangement for transportation of cargoes in containers along a closed loop track according to the invention.

Proposed herein is an arrangement for pneumatic transportation of cargoes in containers 1 (FIG. 1), each container having support rollers 2 and sealing members 3 of any appropriate known design. The arrangement comprises a loading station 4 and an unloading station 5. The loading station 4 has a zone "A" of reception of the containers 1, a loading zone "B" and a zone of "C" of delivery of the containers 1. The unloading station 5 also has a zone "A" of reception of the containers 1, a zone "D" for unloading the containers and a zone "C" of delivery of the containers.

The zone "C" of delivery of the loading station 4 is connected to the zone "A" of reception of the unloading station 5 by means of a pipeline 6, and the zone "C" of delivery of the unloading station 5 is connected to the zone "A" of reception of the loading station 4 by means of a pipeline 7.

The arrangement for displacing the containers along the pipelines 6 and 7 has two sources of compressed air which are referred to below as air blowing stations 8 and 8a. Each of these stations communicates with a respective pipeline 6,7 via air admission pipes 9,10 which are referred to below as pipes. The pipe 9 is connected to the pipeline 6(7) at a distance from the inlet thereof which is not less than the distance between the adjacent sealing members 3 of the adjacent containers 1 when they are in the closest position relative to each other.

A throttle valve 11 is built in the pipe 10. Two throttle valves 12 and 13 are provided in the pipeline 6(7) near the zone "A" of reception of the containers 1. One or several throttle valves may be provided. The pipelines 6 and 7 are portions of a track 14. The loading station 4 and unloading station 5 have a portion 15 of the track 14 in permanent communication with atmosphere having its ends adjoining the pipelines 6 and 7. The pipelines 6 and 7 and the portions 15 of the track 14 form a closed loop path.

Each portion 15 comprises a support rail indicated with the same reference numeral 15 which serves as a guide for support rollers 2 of the container 1. Similar rail 15 (FIG. 2) is provided in the pipelines 6 and 7 (FIG. 1) and also serves as a guide for support rollers 2 of the container 1. The support rail 15 of each handling station 4,5 consists of portions 15a, 15b, 15c located within the zone of reception "A," zones of handling "B," "D" and zone of delivery "C," respectively.

The zones "A" of reception of the containers 1 of the loading station 4 and unloading station 5 are substantially identical so that the description herebelow will equally apply to both stations.

In one embodiment of the present invention, the portion 15a of the support rail in the zone of reception "A" is inclined at an angle "$\alpha$" (FIG. 2) in the direction of movement of the containers 1 indicated by arrow "E." This construction of the portion 15a of the support rail 15 enables the reception of containers with comparatively low rate of their income and their transfer to the handling zone "B"("D") under gravity.

The zones of delivery "C" of each handling station 4,5 are identical so that the description herebelow will equally apply to both stations.

The zone "C" comprises the portion 15c of the support rail which has one adjoining the entrance to the pipeline 6(7) and the other end adjoining to the portion 15b of the handling zone "B"("D"), and an independent drive 16 located over the portion 15c.

The drive 16 is designed for displacing the containers 1 along the portion 15c and for forming a chain of closely arranged containers at this portion. Head containers 1 of the chain are received in the pipeline 6(7), and their sealing members 3 close the cross-sectional area of the pipeline to form a zone of higher pressure therein.

In another embodiment of the present invention and in order to provide for most efficient braking of the containers 1 having different mass and speed at the outlet of the pipeline 6(7) and maximum stabilization of their speed at the end of the braking, a portion 17 of the track 14 within the zone "A" of reception of the containers 1 is arcuated in the horizontal plane and inclined in the direction of movement of containers as indicated by arrow E. This portion of the track comprises the portion 15a of the support rail 15 (FIG. 1) and side rails 18 and 19 (FIGS. 3,4) equidistantly spaced therefrom on either side thereof. During the movement of the container 1, one of the rails having greater radius of curvature engages the lateral side of the container, whereas a member 20 of friction material which in this particular case is ferrodo is secured to the rail.

Figure 5:
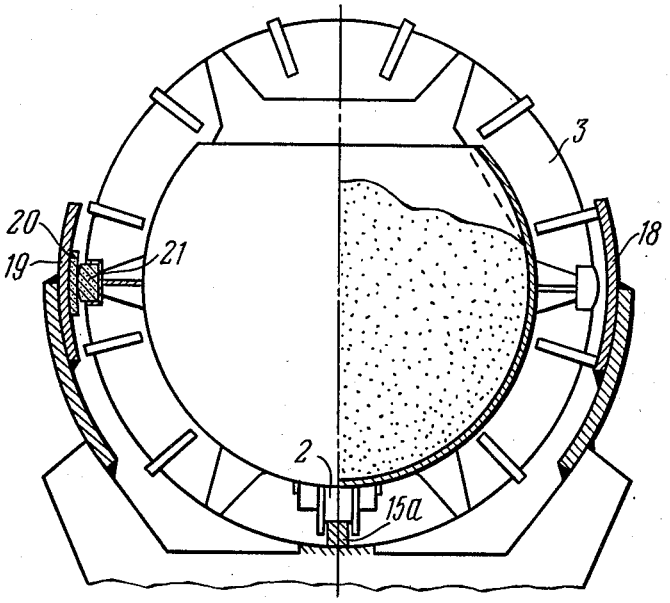
FIG. 5 is an enlarged sectional view taken along the line V—V in FIG. 3.

The member 20 is secured to the side rail 18 at the beginning of the portion 17 at a length $l_1$ thereof since the rail 18 at this portion has greater radius of curvature than the rail 19. The member 20 is also secured to the side rail 19 at a length $l_1$ thereof, and the member 20 is secured to the side rail 18 at a length $l_3$ thereof. Therefore, the container 1 is permanently urged, during its movement along the rail 15a, to a respective side rail 18 or 19 depending on the portion it is moving along. Members 21 of friction material (FIG. 5) are secured to the lateral side of each container 1, said members engaging the members 20 during the movement of the container along the portion 15a of the rail 15.

Figure 1:
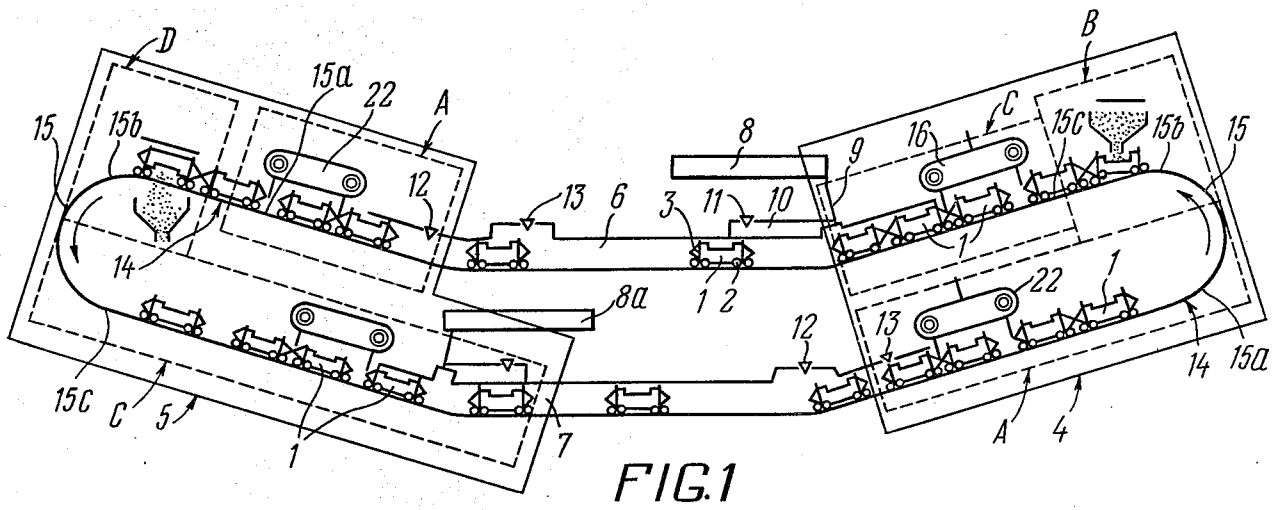
FIG. 1 is a pictorial representation of the arrangement for transportation of cargoes in containers along a closed loop track according to the invention.

In still another embodiment of the present invention and for positive displacement of the containers in the zones of reception "A," there are provided independent drives 22 (FIG. 1). The drive is used to form a chain of containers. The tail container of the chain is received in the pipeline 6(7) and closes the cross-sectional area thereof with its sealing member 3 to form an air plug (air buffer) with the next container moving in the pipeline 6(7).

Figure 2:
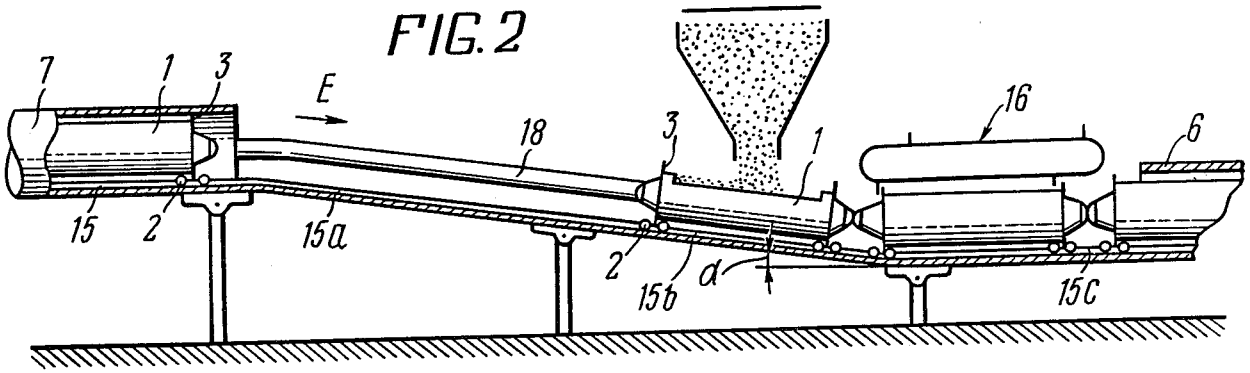
FIG. 2 shows one embodiment of a handling station according to the present invention.
Figure 3:
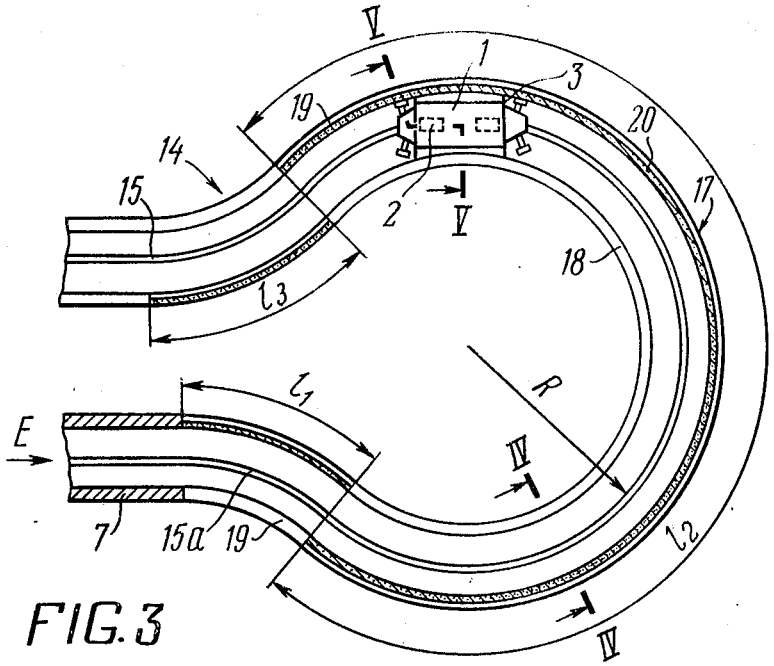
FIG. 3 shows the zone of reception of another embodiment of a handling station, wherein a portion of the track is arcuated.
Figure 4:
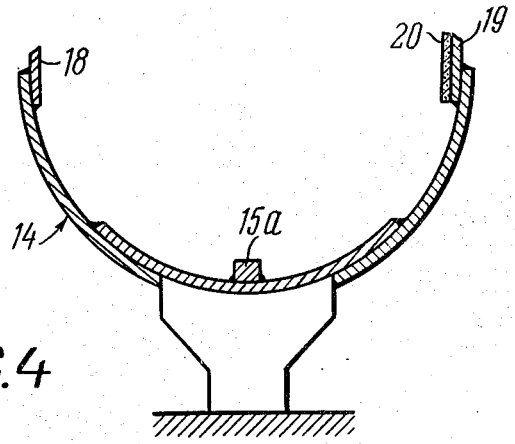
FIG. 4 is an enlarged sectional view taken along the line IV—IV in FIG. 3.

It will be readily appreciated by those skilled in the art that the independent drives 22 illustrated in FIG. 1 can also be used with the embodiment of the handling station illustrated in FIGS. 2 and the embodiment of the zone of reception illustrated in FIG. 3. Also, it will be appreciated that the zones of handling "B," "D," with or without the zone of delivery "C," can be combined with the zone of reception "A" illustrated in FIGS. 3-5.

The independent drives 16 and 22 are of the same design so that the description of one drive equally applies to the other.

The independent drive 22 comprises two vertically closed parallel traction chains 23 (FIGS. 6,7) interconnected by cross-pieces 24 (FIG. 8) equally spaced along the traction chains at the distance which is not greater than the length of the container 1. The traction chains 23 run around tensioning sprokets 25 (FIG. 6) and drive sprokets 26. The links of the chain 23 are interconnected by pivots (FIGS. 7,8). Each cross-piece 24 is secured to the chain 23 by means of plates 28 which in this embodiment are integral with the cross-pieces 24 fitted with the holes thereof on the pivots 27 and perform the function of the links of the chain 23.

A roller 31 engaging the container 1 for moving it is mounted to each cross-piece 24 substantially in the middle thereof on an axle 29 (FIG. 9) journalled in a sleeve 30 secured to the cross-piece 24.

The axle 29 of the roller 31 is in the same plane with the pivots 27 connecting the links of the traction chain 23 to the cross-piece 24 and extend in parallel therewith.

This arrangement of the axles 29 and pivots 27 eliminates bending moment upon engagement of the rollers 31 and the containers 1.

Each container 1 has partition members 32 (FIG. 6) which serve as stops for the roller 31 during the displacement of the container 1 by the independent drive 16 or 22.

The arrangement for transportation of cargoes in containers functions in the following manner.

The air blowing stations 8 and 8*a* continuously supply air flow, via the pipes 9 and 10, to the pipelines 6 and 7 along which the containers 1 move under a pressure difference provided in the air flow, at pre-set time intervals. Loaded containers 1 move along the pipeline 6 from the loading station 4 to the unloading station 5, and the empty containers 1 move in the opposite direction along the pipeline 7.

In the zones "C" of delivery of containers at both stations 4 and 5, the containers 1 are fed in the form of a continuous chain by the independent drives 16, to the inlet of the pipeline 6(7) to overcome the pressure forces. As the sealing member 3 of the head container 1 approaches the air admission pipe 9, a pressure different appears at the sealing member to accelerate the container to a rated speed. At the same time, the chain of closely arranged containers 1 continues to be fed to the inlet of the pipeline 6(7) so that the next container is accelerated in a pre-set time interval.

The above-described continuous process of feeding the containers 1 and their delivery along the pipelines 6(7) to the station of destination provides for the formation in the pipelines of a flow of sequentially moving containers spaced from one another by air "cushions." The containers 1 arrive to the zones of reception "A" of each station, on the average, at the same time interval at which they are delivered from the zones "C." In case the speed of movement of the containers in the pipelines 6 and 7 does not exceed 1-3 m/s, the zone of reception is the open track shown in FIG. 2 which is inclined in the direction of movement. The container 1 leaving the outlet of the pipeline 6 or 7 at the handling stations 4,5 in the reception zone "A" slides down in the direction indicated by arrow E to get in close relation to the container 1 which is the ultimate one in the chain of closely arranged containers which is moved by the independent drive 16 within the zone of delivery "C." The independent drive 16 continuously introduces the containers against the pressure forces into the pipeline 6(7) for their delivery one by one. It will be apparent from the above, that no sluicing is required for bringing the containers 1 to the pipeline 6(7) in this arrangement.

In the arrangements for pneumatic transportation of containers 1 in which the speed of their movement exceeds the above-given values, and the weight and speed of the containers 1 entering the handling stations 4,5 fluctuate over a wide range, the zones of reception "A" of each station are arcuated in plan. This provides for utilization of the centripetal force to both reduce and stabilize the speed of incoming containers 1 of different weights.

In fact, the force of resistance offered to the movement of each container 1, e.g., of an ith container 1, $T_i$, at the curvilinear track within the zone of reception is $$T_i=(m_iV_i^2/R)f,$$

wherein $m_i$ is mass of the ith container;

$V_i$ is speed of the ith container in the zone of reception;

f is coefficient of friction;

R is radius of curvature of the track.

It will be apparent from the above formula that an underloaded container, that is a container of a smaller mass will be braked with a proportionally smaller force, and vice versa, and that a braking force proportional to the square of its increased force is applied to a container moving with greater speed. As a result, at the end of the zone of reception "A," an efficient and simultaneous equalization and lowering of speed of incoming containers take place, the containers adjoining one by one the "tail" of the closely arranged containers which are moved by the independent drive 16 (FIG. 1) of the zone of delivery "C." The zone of loading "B" or the zone of loading "D" is located between the zones or delivery "A" and "C." The containers 1 pass through these zones without stopping at a low speed, and loading and unloading operations are effected during their movement. This considerably simplifies the functional equipment and narrows the range of equipment needed, while the throughput capacity is improved.

With the provision of the independent drive 22 in the zone "A" of reception of the containers (FIG. 1), they are braked in the following manner.

The containers arriving along the pipeline 7(6) are braked due to compression of air in front of them since the outlet of the pipeline 7(6) is permanently closed by the sealing member 3 of the tail container 1 of the chain formed by the independent drive 22.

The independent drives 16,22 also move the containers 1 in the zones of loading and unloading "B" and "D."

The independent drives and containers in engagement therewith are in a holding force transmitting connection. The container 1 engages, with the stop 32 thereof, the roller 31 of the cross-piece 24. The arrangement of the pivots 27 securing the cross-piece 24 to the traction chains 23 and of the axis 29 of the roller 31 in the same plane and in parallel with one another eliminates the appearance of bending moment in the traction chains 23 during the movement of the containers 1 thereby eliminating the need in guides for the chains 23.

The arrangement according to the invention has high throughput capacity, moderate power requirements and is inexpensive in the manufacture.

Pressure of compressed air necessary for the operation of the arrangement does not exceed 1-2 kp/cm$^2$ which is sufficient for transportation of up to 10 million tons of cargoes annually (construction materials, coal, ore and the like) at a distance of up to 20 km along 1-1.2 m diameter pipes.

The pipelines 6 and 7 (FIG. 1) may be laid overhead, on the ground, underground, on the water, underwater and under the bottom and do not require the use of large surface areas.

The track may be constructed of steel, concrete, asbestos cement or polymer pipes of 0.5-1.5 m in diameter, and no special strength requirements are imposed to the pipes since the internal gauge pressure is low.

What is claimed is:

1. An arrangement for transportation of cargoes in containers along a closed loop track comprising:
   - at least two spaced handling stations, each of said handling stations having:
     - a zone of reception of containers comprising a portion of the track permanently communicating with atmosphere and inclined in the direction of movement of containers,
     - a handling zone adjoining said zone of reception of containers and having a portion of the track, and
     - a zone of delivery of containers adjoining said handling zone of containers and comprising:
       - a portion of the track permanently communicating with the atmosphere, and
       - an independent drive for moving the containers along said portion of the track within said zone of delivery of containers;
   - a first pipeline connecting the zone of delivery of one of said handling stations to the zone of reception of a second of said handling stations and serving for moving the containers in one direction;
   - a second pipeline connecting the zone of delivery of a second of said handling stations to the zone of reception of the first handling station and serving for moving said containers in the opposite direction;
   - a source of compressed air; and
   - air admission pipes for connecting said first and second pipelines to said source of compressed air, each of said containers having at least one sealing member closing the cross-sectional area of said first and second pipelines, said air admission pipes being spaced from the entrance to said first and second pipelines at a distance equal to or greater than the distance between the adjacent sealing members of adjacent containers when they are in the closest position relative to each other and permanently communicating with said source of compressed air, said first and second pipelines and portions of the tracks of said handling stations forming a closed loop track, a portion of the track within the zone of reception of one of the handling stations being arcuated in the horizontal plane and having side rails, a member made of friction material being secured to one rail having greater radius of curvature, and members of friction material being secured to the lateral side of each container to interact with the members of the side rails during the movement of the container along the arcuated portion of the track.

2. An arrangement according to claim 1, wherein the zone of reception of the handling station has an independent drive for displacing the containers along the portion of the track within this zone.

3. An arrangement according to claim 2, wherein one of the independent drives comprises vertically closed traction chains running in parallel with each other and interconnected by cross-pieces equidistantly spaced along the traction chains, the distance between the cross-pieces being equal to or less than the length of the container, and a roller interacting with the container being mounted to each cross-piece substantially in the middle thereof in such a manner that its axle is in the same plane with pivots connecting the links of the traction chain to the cross-piece and extends in parallel therewith.

4. An arrangement for transportation of cargoes in containers along a closed loop track comprising:
   - at least two spaced handling stations, each of said handling stations having:
     - a zone of reception of containers comprising a portion of the track permanently communicating with atmosphere and inclined in the direction of movement of containers,
     - a handling zone adjoining said zone of reception of containers and having a portion of the track, and
     - a zone of delivery of containers adjoining said handling zone of containers and comprising:
       - a portion of the track permanently communicating with the atmosphere, and
       - an independent drive for moving the containers along said portion of the track within said zone of delivery of containers comprising vertically closed traction chains running in parallel with each other and interconnected by cross-pieces equidistantly spaced along the traction chains, the distance between the cross-pieces being equal to or less than the length of the container, and a roller interacting with the container being mounted to each cross-piece substantially in the middle thereof in such a manner that its axle is in the same plane with pivots connecting the links of the traction chain to the cross-piece and extends in parallel therewith;
   - a first pipeline connecting the zone of delivery of one of said handling stations to the zone of reception of a second of said handling stations and serving for moving the containers in one direction;
   - a second pipeline connecting the zone of delivery of a second of said handling stations to the zone of reception of the first handling station and serving for moving said containers in the opposite direction;
   - a source of compressed air; and
   - air admission pipes for connecting said first and second pipelines to said source of compressed air, each of said containers having at least one sealing member closing the cross-sectional area of said first and second pipelines, said air admission pipes being spaced from the entrance to said first and second pipelines at a distance equal to or greater than the distance between the adjacent sealing members of adjacent containers when they are in the closest position relative to each other and permanently communicating with said source of compressed air, said first and second pipelines and portions of the tracks of said handling stations forming a closed loop track.

5. An arrangement according to claim 4, wherein the portion of the track within the zone of reception of the handling station is arcuated in the horizontal plane and has side rails, a member made of friction material being secured to one rail having greater radius of curvature, and members of friction material are also secured to the lateral side of each container to interact with the members of the side rails during the movement of the container along this portion of the pipeline.

6. An arrangement according to claim 4, wherein the zone of reception of the handling station has an independent drive for displacing the containers along the portion of the track within this zone.

* * * * *